United States Patent [19]

Perztsch et al.

[11] 3,977,285

[45] Aug. 31, 1976

[54] CUTTING TOOL FOR LONGITUDINALLY CUTTING CONTINUOUS SHEETS OF FILM

[75] Inventors: Albert Perztsch, Munich; Anton Riedel, Gauting; Werner Wilke, Opladen-Luetzenkirchen; Michael Mehltretter, Munich, all of Germany

[73] Assignee: AGFA-Gevaert, A.G., Leverkusen, Germany

[22] Filed: Feb. 3, 1975

[21] Appl. No.: 546,296

[30] Foreign Application Priority Data

Feb. 7, 1974 Germany ..... 2405849

[52] U.S. Cl. ..... 83/501; 83/676

[51] Int. Cl.[2] ..... B26D 1/24

[58] Field of Search ..... 83/500–503, 83/676

[56] References Cited

UNITED STATES PATENTS

| | | | |
|---|---|---|---|
| 3,173,326 | 3/1965 | Gulliksen et al. | 83/501 |
| 3,465,631 | 9/1969 | Reeder, Jr | 83/500 |
| 3,730,043 | 5/1973 | Zimmerman | 83/502 |

FOREIGN PATENTS OR APPLICATIONS

| | | | |
|---|---|---|---|
| 450,764 | 10/1927 | Germany | 83/500 |

*Primary Examiner*—J. M. Meister

*Attorney, Agent, or Firm*—Connolly and Hutz

[57] ABSTRACT

A cutting tool consists of circular, rotatably mounted upper and lower blades, the upper blade extending past the periphery of the cutting shoulder of the lower blade and bearing resiliently against it. The thickness of the cutting shoulder of the lower blade is less than the distance of the said extending of the upper blade, and the material hardness of the upper blade is greater than that of the lower blade.

3 Claims, 5 Drawing Figures

CUTTING TOOL FOR LONGITUDINALLY CUTTING CONTINUOUS SHEETS OF FILM

Figure 1A:
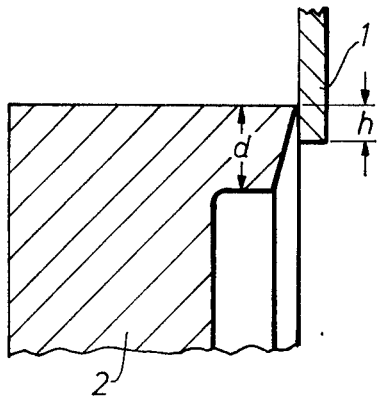
FIG. 1a PRIOR ART

This invention relates to a cutting device with circular upper and lower blades for longitudinally cutting continuous sheets of film, more especially polyester film, the moving sheet of film being cut at that point where the two blades meet.

Sheets of film, more especially coated film for photographic and magnetisable materials, are longitudinally cut into a number of "ribbons" during further processing. The most common longitudinal cutting process is the circular-blade process in which circular upper and lower blades mounted on respective shafts co-operate with one another. In one known embodiment of this process, the circular upper blade extends past the shoulder of the circular lower blade. When films with abrasive coatings, for example magnetic tapes coated with iron oxide or chromium dioxide, are being cut, the cutting edges are rapidly worn away, the upper blade biting into the lower blade as wear progresses. If edge wear becomes more severe, for example of the order of the film thickness, the blades begin to pinch as they cut, resulting in low-quality cutting. This is reflected in the cut which, when the ribbons are subsequently wound into rolls, results in the formation of non-uniform rolls. In cases such as these, the blades have to be replaced and reground in order to obtain a sharp cutting edge again. The disadvantages of having repeatedly to replace blades are obvious.

Accordingly, the object of the invention is to increase the service life of the cutting tools, i.e to enable the blades to be used for as long as possible before they have to be reground.

According to the invention there is provided a cutting tool for cutting thin films, comprising a circular, rotatably mounted upper blade and a circular, rotatably mounted lower blade, the upper blade extending beyond the periphery of a cutting shoulder of the lower blade by an amount which exceeds the thickness of the cutting shoulder, and means for urging the upper and lower blades resiliently against one another, the material of which the upper blade is made being harder than the material of which the lower blade is made.

In the invention the configuration of the cutting tool and the materials used for the cutting tool eliminates the need for regrinding and, hence, replacement of the blade. The service life of the blade is increased by at least five times, being equivalent to more than 2 million meters of film.

By using upper blades especially made of hard metal, a certain amount of material is worn away from the lower blade (grooved blade) during cutting, leaving the cutting surface of the shoulder with a surface finish which could not be obtained by machining or grinding. The configuration of the lower blade, used in the invention, enables the blades to be used virtually down to the end of the shoulder.

Figure 2:
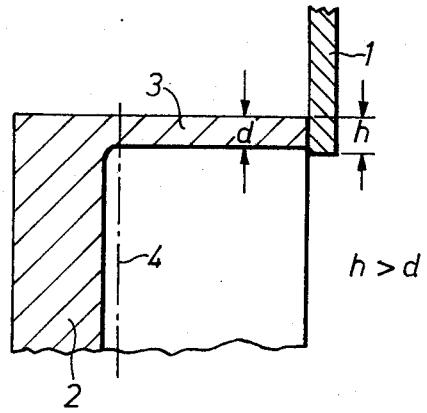

One embodiment of the invention is described by way of example in the following with reference to the accompanying drawings from which all those parts that do not directly affect the invention have been omitted and in which:

FIGS. 1*a*, *b* and *c* are cross-sections through the upper and lower blades of known cutting tools with varying degrees of wear, FIG. 2 is a cross-section through a pair of blades according to the invention.

Figure 3:
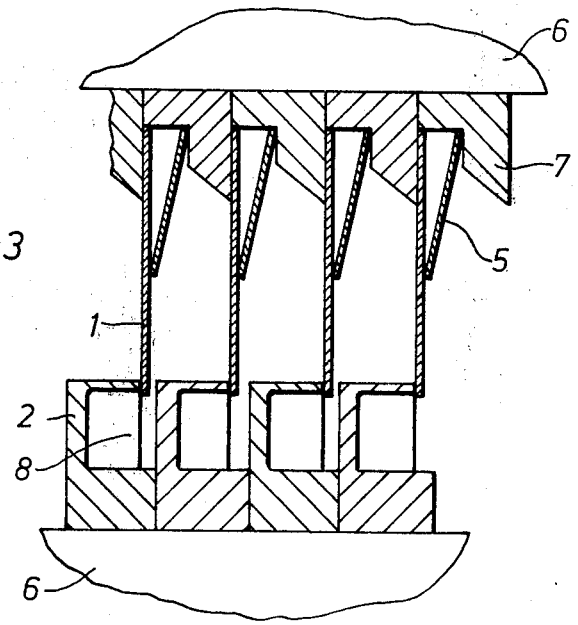

FIG. 3 is a cross-section through several cutting tools according to the invention mouunted on the corresponding shafts.

Cutting devices shown in FIGS. 1 to 3 consists of a circular upper blade 1 and a lower blade 2 which is also circular. The lower blade 2 has a cutting shoulder 3 (thickness *d*). The upper blade consists of a circular disc of rectangular cross-section which is pressed against the cutting shoulder 3 by central spring-mounting, cup-spring mounting or spring washer 5 (see FIG. 3) or rubber spring-mounting. The lower edge of the upper blade 1 is offset relative to the surface of the lower blade by a distance *h*, in other words the upper blade 1 extends beyond the periphery of the cutting shoulder 3 of the lower blade 2 (depth of penetration *b*).

Figure 1B:
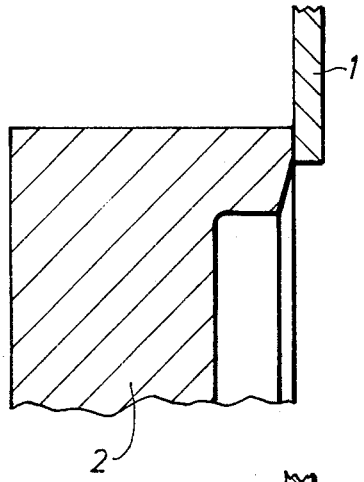
FIG. 1b PRIOR ART
Figure 1C:
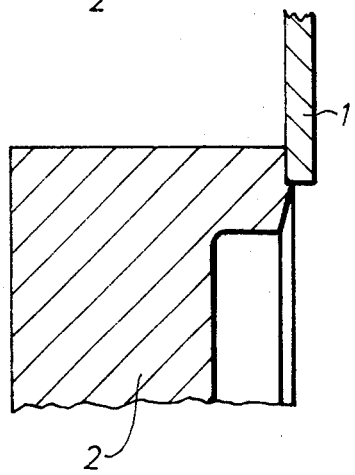
FIG. 1c PRIOR ART

In operation, the two blades 1 and 2 rotate in opposite directions, rubbing against one another in the vicinity of the contact surfaces. FIGS. 1*a* to *c* diagrammatically illustrate the wear phenomena due to erosion of the cutting shoulder 3 in known cutting blades. FIGS. 1*a* shows the original state. The upper blade 1 and the lower blade 2 are new or have been reground. The cutting shoulder 3 of the lower blade 2 has a sharp cutting edge at its front end. FIG. 1*b* shows the cutting edge of the lower blade having been worn down by prolonged use. FIG. 1*c* shows an even more advanced state of wear. In this state, the upper blade 1 has already started to bite into the cutting shoulder 3 of the lower blade 2. The cutting edge of the upper blade can also be damaged in this way. When the upper and lower blades are in this state, they pinch the film which leaves the ribbons with every uneven cut edges. The blades then have to be replaced or reground.

FIG. 2 shows one example of the configuration of the lower blade used in the invention. In this case, the cutting shoulder 3 of the lower blade 2 is not bevelled, and instead its front end adjoins the inner surface of the upper blade 1. The lower end of the upper blade 1 projects beyond the cutting shoulder 3 by a few tenths of a millimeter, in other words the depth of penetration of the upper blade 1 is greater by a few tenths of a millimeter than the thickness *d* of the cutting shoulder 3 of the lower blade 2. In practice, a blade overlap of, for example, only 0.2 mm is sufficient to obtain a distinct improvement in relation to the known cutting tool. The thickness of the cutting shoulder 3 is of the order of 1 milliliter. The upper blade 1 is made of a harder material (for example Krupp's metal carbide WIDIA) than the lower blade (for example tool steel). In this way, the entire circular surface of the lower blade 2 is uniformly worn away and always adjoins the inner surface of the upper blade 1 in plane-parallel alignment. It has surprisingly been found that, as a result of the even erosion from the cutting shoulder 3, the cutting edge of the lower blade, throughout its entire service life, has a degree of sharpness which cannot be obtained by normal grinding. The service life of the cutting shoulder 3 comes to an end when it has been ground away down to its end 4. Thus, the quality of the cut edges of the ribbons remains constant. All that is required is to reset the contact pressure of the spring-mounted upper blade. This can be done while the cutting device is in operation, so that there are no breaks in the continuity of operation.

FIG. 3 diagrammatically illustrates a multiple cutting tool of the kind used for producing ribbons from a wide continuous sheet. The upper blades 1 and the lower blades 2 are arranged at equal intervals on the shafts 6. The upper blades 1 penetrate at their periphery into a groove 8 in the lower blades formed by the front surface of a cutting shoulder and the rear of the next lower blade. The lower blades 2 are fixedly mounted on the shaft 6. The upper blades 1 are mounted on the upper shaft 6 and are braced by the cup springs 5 against the reference parting plane of the spacer rings 7 which provide for a constant interval between the upper blades and hence for a constant cutting width as well. The cup springs 5 can of course be substituted by other kinds of springs.

What we claim is:

1. A cutting tool for cutting thin films into parallel strips, comprising a number of circular, rotatably mounted upper blade and a number of circular, rotatably mounted lower blade having a circular outer edge, the blades being rotatably mounted upon parallel axes, an annular recess in the side of each lower blade near its outer edge which leaves an annular cutting shoulder of substantial length which is almost the entire width of the lower blade extending from the side of the outer edge of the lower blade, the annular recess and cutting shoulder having joint outer and inner peripheries, the upper blades extending beyond the inner periphery of the cutting shoulders of the lower blades, spring means urging the upper blades resiliently against the lower blades, the material of which the upper blades are made being harder than the material of which the lower blades are made whereby the lower blade shoulders wear away by contact with the upper blades, the outer and inner peripheries of the cutting shoulders being disposed substantially parallel to the axes whereby the radial dimensions of the lower blades remain constant as the lower blades wear away, the upper blades being separated by spacer rings and being mounted on a upper shaft, the lower blades being mounted on a lower shaft with adjacent upper blades and lower blades in contact with each other, the upper blades being relatively long and flexible, the spring means reacting between the upper shaft and a mid portion of the upper blades whereby a substantially constant cutting width is maintained between each pair of contacting upper and lower blades as the lower blades wear away, with the upper blades remaining on contact therewith almost across the entire width of the lower blades, the spring means comprises spring washers mounted on the upper shaft about the spacer rings, and each of the spring washers reacting between the spacer rings and the mid portion of the upper blades.

2. A cutting tool as claimed in claim 1, wherein the upper blade is made of a relatively hard metal and the lower blade is made of chromium steel.

3. A cutting tool as claimed in claim 1 wherein the upper blade and lower blade are mounted on parallel upper and lower shafts, a spacer ring is mounted on the upper shaft adjacent the upper blade, a step on the spacer ring, and a spring washer mounted on the upper shaft and reacting between the step on the spacer ring and the upper blade for resiliently urging the upper blade into contact with the lower blade.

* * * * *